United States Patent [19]

Kunitz et al.

[11] 4,267,263

[45] May 12, 1981

[54] USE OF β-AMINOETHYL CARBAMIC ACID FOR PRODUCING PHOTOGRAPHIC BATHS AND DEVELOPER COMPOSITIONS

[75] Inventors: Friedrich-Wilhelm Kunitz; Erich Wolff; Karl Frank, all of Leverkusen, Fed. Rep. of Germany

[73] Assignee: AGFA-Gevaert, A.G., Leverkusen, Fed. Rep. of Germany

[21] Appl. No.: 102,999

[22] Filed: Dec. 12, 1979

[30] Foreign Application Priority Data

Dec. 20, 1978 [DE] Fed. Rep. of Germany ..... 2854942

[51] Int. Cl.[3] ..... G03C 5/30

[52] U.S. Cl. ..... 430/469; 430/484; 430/487

[58] Field of Search ..... 430/469, 484, 487, 599, 430/450

[56] References Cited

U.S. PATENT DOCUMENTS

| | | | |
|---|---|---|---|
| 2,191,037 | 2/1940 | Mannes et al. | 430/469 |
| 3,163,536 | 12/1964 | Nishio et al. | 430/599 |
| 3,640,715 | 2/1972 | Huckstadt et al. | 430/599 |

*Primary Examiner*—J. Travis Brown

*Attorney, Agent, or Firm*—Connolly & Hutz

[57] ABSTRACT

β-Aminoethyl carbamic acid is useful in photographic baths and developer compositions in order to accelerate the development.

8 Claims, No Drawings

USE OF β-AMINOETHYL CARBAMIC ACID FOR PRODUCING PHOTOGRAPHIC BATHS AND DEVELOPER COMPOSITIONS

This invention relates to the use of β-aminoethyl carbamic acid for the production of photographic baths and to developer compositions containing β-aminoethyl carbamic acid.

It is known from U.S. Pat. No. 3,163,536 that the development of exposed photographic recording materials containing silver halide can be accelerated by adding N-[(dialkylamino)alkyl]carbamates to the emulsions of these materials. It is also known that so-called development accelerators can be added to photographic developers containing a developer substance for accelerating the development of photographic materials containing silver halide. East German Pat. No. 5867 describes a process for the chromogenic development of silver halide emulsion layers by reversal development, in which ammonia or primary or secondary amines are added to the first developer. Ethylene diamine is an example of a suitable compound. It is known from U.S. Pat. No. 2,191,037 that primary aliphatic amines, for example ethylene diamine, can be added to colour developers.

Under normal conditions, ethylene diamine is liquid and can have the disadvantages associated with this property. For example, vessels containing ethylene diamine may expand undesirably when transported by air, because under the reduced air pressure at relatively high altitudes a certain amount of the liquid ethylene diamine evaporates and causes the vessel to expand. In addition, ethylene diamine may give off a pungent odour and has to be used with particular care because it is highly corrosive.

The object of the present invention is to provide a substance which does not have any of these disadvantages.

It has been found that β-aminoethyl carbamic acid can be used for the production of photographic baths and accelerates development just as effectively as ethylene diamine.

Photographic baths have also been found, which contain β-aminoethyl carbamic acid.

A developer composition has also been found, consisting of at least two parts which are combined with one another for use, at least one part of this developer composition containing β-aminoethyl carbamic acid. In a preferred developer composition, one part thereof consists of crystalline β-aminoethyl carbamic acid.

β-Aminoethyl carbamic acid is known from German Patent Specification No. 123,138 and, according to *ACTA CHEMICA SCANDIAVICA* 9 (1955), pages 486 to 492, corresponds to the following formula:

$$NH_3^{\oplus}—CH_2—CH_2—NH—COO^{\ominus}$$

β-Aminoethyl carbamic acid is preferably produced by reacting ethylene diamine with solid carbon dioxide or with gaseous carbon dioxide in the presence of an aqueous-alcoholic solution. This reaction is carried out with particular advantage in methanol/water.

For producing photographic baths, particularly photographic developers, β-Aminoethyl carbamic acid may be used in the same way as ethylene diamine. In particular, it may be used instead of ethylene diamine for producing developers containing carbonate ions. Where ethylene diamine is replaced by β-aminoethyl carbamic acid in developers containing carbonate ions, it is merely necessary to add a base, for example potassium hydroxide, in a quantity equivalent to the carboxyl groups of the β-aminoethyl carbamic acid and then optionally to introduce an alkali carbonate, for example potash, in the quantity required to obtain the alkali carbonate concentration of an analogous developer containing ethylene diamine instead of β-aminoethyl carbamic acid.

β-aminoethyl carbamic acid may be used in any developers, for example in black-and-white or colour developers and in both first developers and second developers for reversal processing. In a preferred embodiment, β-aminoethyl carbamic acid is used when the developer substances employed are readily salted out by a high content of foreign salts. Developer substances such as these are generally hydrophobic. They include for example developer substances of the p-phenylene diamine type corresponding to the following formula:

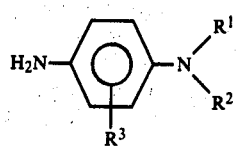

Formula (I)

in which $R^1$ and $R^2$, which may be the same or different, represent a standard substituent, particularly alkyl containing from 1 to 4 carbon atoms, and $R^3$ represents hydrogen or a standard substituent particularly alkyl containing from 1 to 4 carbon atoms.

The substituents $R^1$, $R^2$ and $R^3$ may optionally be substituted by further substituents, such as OH, O-alkyl, $SO_3H$ or $—NH—SO_2—CH_3$.

The following developer substances are examples of developer substances of this type:

Developer substance (II):

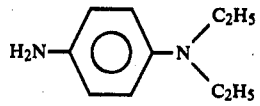

Formula (II)

and

Developer substance (III):

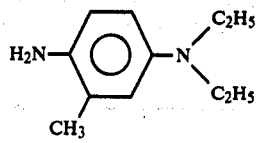

Formula (III)

In addition to the developer substance, the developers containing β-aminoethyl carbamic acid may contain other substances of the type normally encountered in photographic developers, such as for example antilime or sequestering agents. The final developer ready for use may be adjusted to an alkaline pH-value with any of the usual reagents, particularly alkali carbonates.

The developers produced according to the invention may be used for developing standard photographic materials. For example, the photographic material may contain the usual colour couplers which may be incorporated into the silver halide layers themselves. The colour couplers present may for example include 2-equivalent couplers and DIR-couplers. Gelatin may be used as binder for the photographic layers, although it may be completely or partly replaced by other natural or synthetic binders. The emulsions of the photographic material may be chemically and optically sensitised in known manner and may contain known stabilisers.

The β-aminoethyl carbamic acid may be used over a wide range of concentrations. The concentration depends on the type of photographic material in question, by the developer and by the effect required. In general, the effects required are obtained with quantities of from 2 g to 40 g more particularly from 4 g to 16 g, of the β-aminoethyl carbamic acid per liter of the finished developer.

β-aminoethyl carbamic acid may be packed together with other solid constituents of a developer composition. In a preferred embodiment, it is packed separately from the acid and alkaline constituents of the developer.

The fact that β-aminoethyl carbamic acid can be used in photographic baths, particularly photographic developers, is all the more suprising insofar as a prejudice against the use of carbamates in photographic developers existed from German Auslegeschrift No. 1,269,484.

EXAMPLE

A standard colour photographic reversal multilayer material containing a red-sensitive, a green-sensitive and a blue-sensitive silver halide emulsion layer and colour couplers for the corresponding partial images of the photosensitive layers is exposed imagewise and subjected to the following processing cycle:

| Bath | Time (minutes) | Temperature (°C.) |
|---|---|---|
| First development | 18 | 20 |
| Stopping | 4 | 20 |
| Washing | 5 | 17 |
| Diffuse second exposure in flowing water | 2 | 17 |
| Colour Development | 14 | 20 |
| Washing | 20 | 17 |
| Bleaching | 5 | 20 |
| Washing | 5 | 17 |
| Fixing | 5 | 20 |
| Washing | 12 | 17 |

Standard photographic baths are used for the first development, bleaching and fixing. For colour development, the two colour developers A and B produced by combining the following substances were used for different samples of the material:

| Substance | Developer A (comparison) | Developer B (according to invention) |
|---|---|---|
| Ethylene diamine tetra-acetic acid | 2.5 g | 2.5 g |
| Disodium salt of hydroxyethane-1,1-diphosphonic acid | 2 g | 2 g |
| Hydroxylamine sulphate | 1.2 g | 1.2 g |
| $Na_2SO_3$, sicc | 5 g | 5 g |
| Developer substance II | 5 g | 5 g |
| $K_2CO_3$ | 75 g | 57 g |
| KBr | 2 g | 2 g |
| Ethylene diamine, 50% | 16 ml | / |
| β-aminoethyl carbamic acid | / | 14 g |

-continued

| Substance | Developer A (comparison) | Developer B (according to invention) |
|---|---|---|
| KOH | / | 15 g |

Developers A and B were made up with water to 1 liter and had a pH-value of 11.7. The developer was used 24 hours after its preparation.

Developer A was prepared in accordance with the prior art and developer B in accordance with the invention. In both cases, the same sensitometric results were obtained after processing of the same photographic material.

We claim:

1. The method of preparing a developer composition for processing color photographic materials, said composition used in development of exposed silver halide emulsion material of the photographic material, including the steps of first preparing a solution comprising a developer substance corresponding to the following general formula:

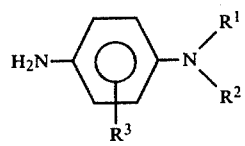

FORMULA (I)

in which $R^1$ and $R^2$ may be the same or different and represent alkyl containing from 1 to 4 C-atoms;

$R^3$ represents hydrogen or alkyl containing from 1 to 4 C-atoms, wherein $R^1$, $R^2$ and $R^3$ may optionally be substituted by OH, O-alkyl, $SO_3H$ or NH—$SO_2$—$CH_3$;

and adding to the composition the accelerator β-aminoethyl carbamic acid in an amount to effectively accelerate development with said composition.

2. The method as claimed in claim 1 wherein the β-aminoethyl carbamic acid is added in an amount of 2 g to 40 g per liter of developer composition.

3. The method as claimed in claim 1, characterized in that the developer substance corresponds to one of the following formulae:

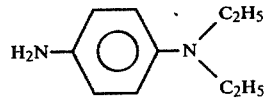

FORMULA (II)

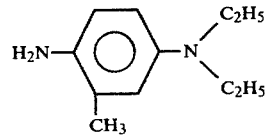

FORMULA (III)

4. The method as claimed in claim 3, wherein 2 g to 40 g of β-amino ethyl carbamic acid per liter of finished developer are used.

5. A photographic developer composition for aqueous development of photosensitive photographic materials containing at least one silver halide emulsion including at least one developer substance having the following formula:

(I)

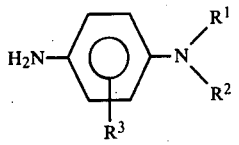

in which $R^1$ and $R^2$ may be the same or different and represent alkyl containing from 1 to 4 C-atoms;

$R^3$ represents hydrogen or alkyl containing from 1 to 4 C-atoms, wherein $R^1$, $R^2$ and $R^3$ may optionally be substituted by OH, O-alkyl, $SO_3H$, or NH—$SO_2$—$CH_3$;

and having an accelerator compound for accelerating the development of said photographic materials containing silver halide, wherein said compound includes β-aminoethyl carbamic acid.

6. The photographic developer composition as claimed in claim 5 in which the accelerator compound consists of β-aminoethyl carbamic acid.

7. A bath for processing photographic materials in the development of exposed silver halide emulsions in the material containing a solution of a developer substance corresponding to the following formula:

(I)

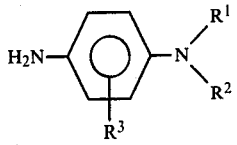

in which $R^1$ and $R^2$ may be the same or different and represent alkyl containing from 1 to 4 C-atoms;

$R^3$ represents hydrogen or alkyl containing from 1 to 4 C-atoms, wherein $R^1$, $R^2$ and $R^3$ may optionally be substituted by OH, O-alkyl, $SO_3H$, or NH—$SO_2$—$CH_3$;

and β-aminoethyl carbamic acid in an amount to effectively accelerate development of photographic materials containing silver halide.

8. A bath as claimed in claim 7, which contains from 2 g to 40 g of β-aminoethyl carbamic acid per liter of finished developer.

* * * * *